US010179387B2

(12) United States Patent
McRoberts et al.

(10) Patent No.: US 10,179,387 B2
(45) Date of Patent: Jan. 15, 2019

(54) LOW HEIGHT QUARTER SHEET SANDER

(71) Applicant: BLACK & DECKER INC., Newark, DE (US)

(72) Inventors: Jason McRoberts, Windsor, PA (US); Terry L. Turner, Oakland, MD (US); Jennifer A. Resh, Baltimore, MD (US); Timothy W. French, Jr., Hampstead, MD (US)

(73) Assignee: Black & Decker Inc., New Britain, CT (US)

( * ) Notice: Subject to any disclaimer, the term of this patent is extended or adjusted under 35 U.S.C. 154(b) by 1055 days.

(21) Appl. No.: 13/858,983

(22) Filed: Apr. 9, 2013

(65) Prior Publication Data

US 2013/0217312 A1 Aug. 22, 2013

Related U.S. Application Data

(63) Continuation of application No. 13/548,327, filed on Jul. 13, 2012, now Pat. No. 8,435,097, which is a continuation of application No. 12/040,971, filed on Mar. 3, 2008, now Pat. No. 8,231,437.

(51) Int. Cl.

| | |
|---|---|
| ***B24B 23/03*** | (2006.01) |
| ***B24B 23/04*** | (2006.01) |
| ***B24B 7/00*** | (2006.01) |

(52) U.S. Cl.

CPC ..... *B24B 7/00* (2013.01); *B24B 7/005* (2013.01); *B24B 23/03* (2013.01); *B24B 23/04* (2013.01)

(58) Field of Classification Search

CPC ..... B24B 7/00; B24B 7/005; B24B 23/00; B24B 23/03; B24B 23/05

USPC ..... 451/344, 356, 357, 359

See application file for complete search history.

(56) References Cited

U.S. PATENT DOCUMENTS

| | | | | |
|---|---|---|---|---|
| 4,027,597 | A | 6/1977 | Lang | |
| 4,703,211 | A | 10/1987 | Yazaki et al. | |
| 4,715,732 | A * | 12/1987 | Sanders | 384/320 |
| 4,893,436 | A * | 1/1990 | Rich | 451/442 |
| 5,018,314 | A | 5/1991 | Fushiya et al. | |
| 6,004,197 | A | 12/1999 | Huber | |

(Continued)

FOREIGN PATENT DOCUMENTS

| | | |
|---|---|---|
| DE | 9315019 | 2/1995 |
| GB | 578027 A | 6/1946 |

(Continued)

OTHER PUBLICATIONS

International Search Report and Search Opinion for EP 09 015 3331, dated Jun. 30, 2009.

*Primary Examiner* — Eileen Morgan

(74) *Attorney, Agent, or Firm* — Stephen R. Valancius

(57) ABSTRACT

A power tool including a housing with an electric motor in the housing. The motor has a stator and an armature, the stator having field coils and the armature having an armature shaft on which a commutator is affixed. A pair of brush boxes are located in the housing on opposite sides of the commutator. An orbit mechanism coupled to the armature shaft and a platen is coupled to the orbit mechanism. The field coils comprise a first field coil facing a front of the sander and a second field coil facing a rear of the sander and the brush boxes are rotationally offset from the field coils with respect to a vertical axis of the sander.

19 Claims, 4 Drawing Sheets

(56) References Cited

U.S. PATENT DOCUMENTS

| | | | | |
|---|---|---|---|---|
| 6,149,511 | A | 11/2000 | Huber | |
| 6,190,245 | B1* | 2/2001 | Heidelberger et al. | 451/357 |
| 6,257,970 | B1 | 7/2001 | Huber | |
| 6,328,643 | B1 | 12/2001 | Huber | |
| 6,855,040 | B2 | 2/2005 | Huber | |
| 6,979,254 | B1 | 12/2005 | Huber | |
| 7,078,843 | B2 | 7/2006 | Du et al. | |
| 7,205,696 | B2 | 4/2007 | Du et al. | |
| 7,211,920 | B2 | 5/2007 | Du et al. | |
| 7,270,591 | B2 | 9/2007 | Deshpande et al. | |
| 7,318,768 | B2 | 1/2008 | Deshpande et al. | |
| 2005/0245182 | A1* | 11/2005 | Deshpande et al. | 451/357 |
| 2005/0245183 | A1* | 11/2005 | Deshpande et al. | 451/357 |
| 2006/0141915 | A1* | 6/2006 | Walstrum et al. | 451/344 |
| 2007/0207703 | A1 | 9/2007 | Deshpande et al. | |

FOREIGN PATENT DOCUMENTS

| | | | |
|---|---|---|---|
| GB | 823986 | A | 11/1959 |
| GB | 2321207 | A | 7/1998 |

* cited by examiner

LOW HEIGHT QUARTER SHEET SANDER

CROSS-REFERENCE TO RELATED APPLICATIONS

This application is a continuation of U.S. patent application Ser. No. 13/548,327 filed Jul. 13, 2012, and application Ser. No. 12/040,971 filed on Mar. 3, 2008, and issued on Jul. 31, 2012 as U.S. Pat. No. 8,231,437. The entire disclosure of the above applications are incorporated herein by reference.

FIELD

The present disclosure relates to electric sanders, and more particularly, to a low height quarter sheet electric sander.

BACKGROUND

The statements in this section merely provide background information related to the present disclosure and may not constitute prior art.

An electric quarter sheet sander is a type of orbital sander having an electric motor that drives an orbit mechanism that moves a platen in an orbital pattern. A sheet of sandpaper is removably fastened to the platen. When the platen with the sandpaper fastened thereto is applied to a work surface, such as to wood, the orbital motion of the platen moves the sandpaper in an orbital motion against the work surface to sand it. Since a full sheet of sandpaper is 9"×11" and the sheet of sandpaper fastened to the platen is 4½"×5½", or ¼ of a full sheet of sandpaper, sanders of this type are commonly known as ¼ sheet sanders.

One disadvantage ¼ sheet electric sanders have suffered is due to the height of the sander. If the user grasps the sander by placing the palm of the user's hand over the top of the sander, the user's hand is sufficiently far from the work that the user is sanding to cause more fatigue than is the case with pneumatic orbital or random orbital sanders where the user can grasp the sander close to the work piece. This often leads to user's grasping electric ¼ sheet sanders on the side of the sander. This tends to be awkward compared to grasping the top of the housing. Also, the greater height of the ¼ sheet electric sander causes more wobble compared to the lower height pneumatic orbital sander.

FIGS. 1, 3 5, and 7 show a prior art Black & Decker QS800 series and KA171 ¼ sheet electric sander 100. Sander 100 has a housing 102 that includes first and second clamshell halves 104, 106 mated together. An upper portion of housing 102 is formed as a handle 108. An on-off switch 110 is disposed in front end 109 of handle 108 of housing 102. An electric motor 300 (FIGS. 3 and 5) is disposed in housing 102. Electric motor 300 is a universal AC motor having a field or stator 302 and an armature 308. Stator 302 includes a lamination stack 304 having field coils 306 wound in slots (not shown) therein. Motor 300 is a two-pole motor and stator 302 includes two field coils 306. Armature 308 extends through lamination stack 304 of stator 302. Armature 308 has an armature shaft 310 extending through and affixed to a lamination stack 312. Lamination stack 312 includes slots (not shown) in which armature coils (not shown) are wound. Portions of armature shaft 310 generally at upper end 316 and lower end 318 (FIG. 7) thereof (as oriented in the drawings) are entrained in upper bearing 320 and lower bearing 322 (FIG. 7) (as oriented in the drawings). Upper and lower bearings 320, 322 are received in bearing holders 324, 326 formed in clamshell halves 104, 106 of housing 102. A commutator 314 is affixed to armature shaft 310 toward upper end 316 thereof.

A fan 328 is affixed to armature shaft 310 toward a lower end of armature shaft 310 and an orbit mechanism 330 (FIG. 5) is coupled to the lower end 318 of armature shaft 310. Fan 328 is illustratively disposed in housing 102 and at least a portion of orbit mechanism 330 (FIG. 5) extends below a bottom 111 of housing 102. A platen 112 is coupled to orbit mechanism 330. A ¼ sheet of sandpaper 114 is removably secured to platen 112.

Clamshell housing halves 104, 106 each include a plurality of screw bosses, illustratively six, for receiving screws (not shown) that hold clamshell halves 104, 106 together. The screw bosses may illustratively be threaded screw bosses in one of clamshell halves 104, 106 and through holes in the other of clamshell halves 104, 106. The screw bosses of each clamshell housing half include a pair of upper screw bosses 336 generally at opposite sides of upper bearing 320, a pair of lower screw bosses 338 generally at and slightly above opposite sides of lower bearing 322, and a pair of screw bosses 340 (FIG. 5) at an upper back end of handle 108 of housing 102 generally where a cordset 116 enters housing 102 and connects to a terminal block 341 (FIG. 3). When clamshell halves 104, 106 are mated together, the screw bosses extend across housing 102 from one clamshell half 104 to the other clamshell half 106. Switch 110 and terminal block 341 are disposed in a horizontal elevation (when sander 100 is upright) above a horizontal elevation of brush boxes 332.

Two brush boxes 332 are disposed on opposite sides of commutator 314 in respective brush box retainers 334 formed in clamshell halves 104, 106 of housing 102. Brush boxes 332 are located in housing 102 so that they bridge across clamshell halves 104, 106 of housing 102. Stator 302 of electric motor 300 is located in housing 102 so that one field coil 306 is disposed in clamshell half 104 and the other field coil 306 is disposed in clamshell half 106 and are generally parallel to each other. Each field coil 306 thus extends across the respective clamshell half 104, 106 in which it lies and not toward the other clamshell half 104, 106. When clamshell halves 104, 106 are mated, edge 344 of clamshell half 104 and edge 346 (FIG. 5) of clamshell half define a vertical plane 352 (when sander 100 is upright). A horizontal (when sander 100 is upright) centerline 348 (FIG. 7) of brush boxes 332 (a line that extends through the centers of the brush boxes 332) lies in that vertical plane 352 and a horizontal centerline 350 (FIG. 7) of field coils 306 (a line that extends through the centers of field coils 306) lies in a vertical plane 354 that is rotated ninety degrees with respect to plane 352. Centerline 348 (FIG. 7) of brush boxes 332 and centerline 350 (FIG. 7) of field coils 306 are thus rotated ninety degrees with respect to each other.

As best shown in FIG. 5, field coils 306 are sufficiently wide so that they bridge across lower screw bosses 338 and housing 102 must thus have sufficient height so that lower ends 342 of field coils 306 are above lower screw bosses 338. As best shown in FIG. 3, switch 110 and terminal block 341 are disposed above brush boxes 332.

Sander 100 has a height, the distance from the top of handle 108 to the bottom of platen 112, of 155 mm. Lamination stack 304 of stator 302 of electric motor 300 has a height of 25 mm and commutator 314 has a height of 15 mm. Electric motor 300 is illustratively a 230 volt, 50 Hz, 200 watt, 15,000 RPM (no load speed) motor or a 120 volt, 60 Hz, 2 amp, 15,000 RPM (no load speed) motor.

SUMMARY

A reduced height quarter sheet sander has a housing having first and second halves mated together. An upper portion of the housing provides a handle. An electric motor is disposed in the housing. The electric motor has a stator and an armature. The stator has field coils and the armature has an armature shaft on which a commutator is affixed. A pair of brush boxes is disposed in the housing on opposite sides of the commutator. An orbit mechanism is coupled to the armature shaft and a platen is coupled to the orbit mechanism. In an aspect, a switch disposed in the handle of the housing and a terminal block (at which a cordset that enters the housing terminates) disposed in the handle of the housing have generally the same horizontal elevation as the brush boxes (when the sander is upright). In an aspect, first and second halves of the housing have lower screw bosses generally on opposite sides of the electric motor that extend across the housing from one half to the other half, the stator disposed in the housing so that the field coils extend across the housing from one housing half to the other housing half and outside the lower screw bosses wherein bottoms of the field coils are horizontally adjacent or below the lower screw bosses.

In an aspect, edges of the halves of the housing define a vertical plane when the housing halves are mated together and the sander is upright, and a horizontal centerline of the brush boxes is perpendicular to that vertical plane. In an aspect, a horizontal centerline of the field coils lies in the vertical plane defined by the edges of the housing halves and the horizontal centerline of the brush boxes is perpendicular to the centerline of the field coils.

In an aspect, top and bottom portions of the field coils are bent outwardly and toward each other.

In an aspect, the sander has a vertical height of that does not exceed 135 mm. In an aspect, the sander has a vertical height that does not exceed 130 mm. In an aspect, the sander has a vertical height that does not exceed about 125 mm.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figures 1, 2:
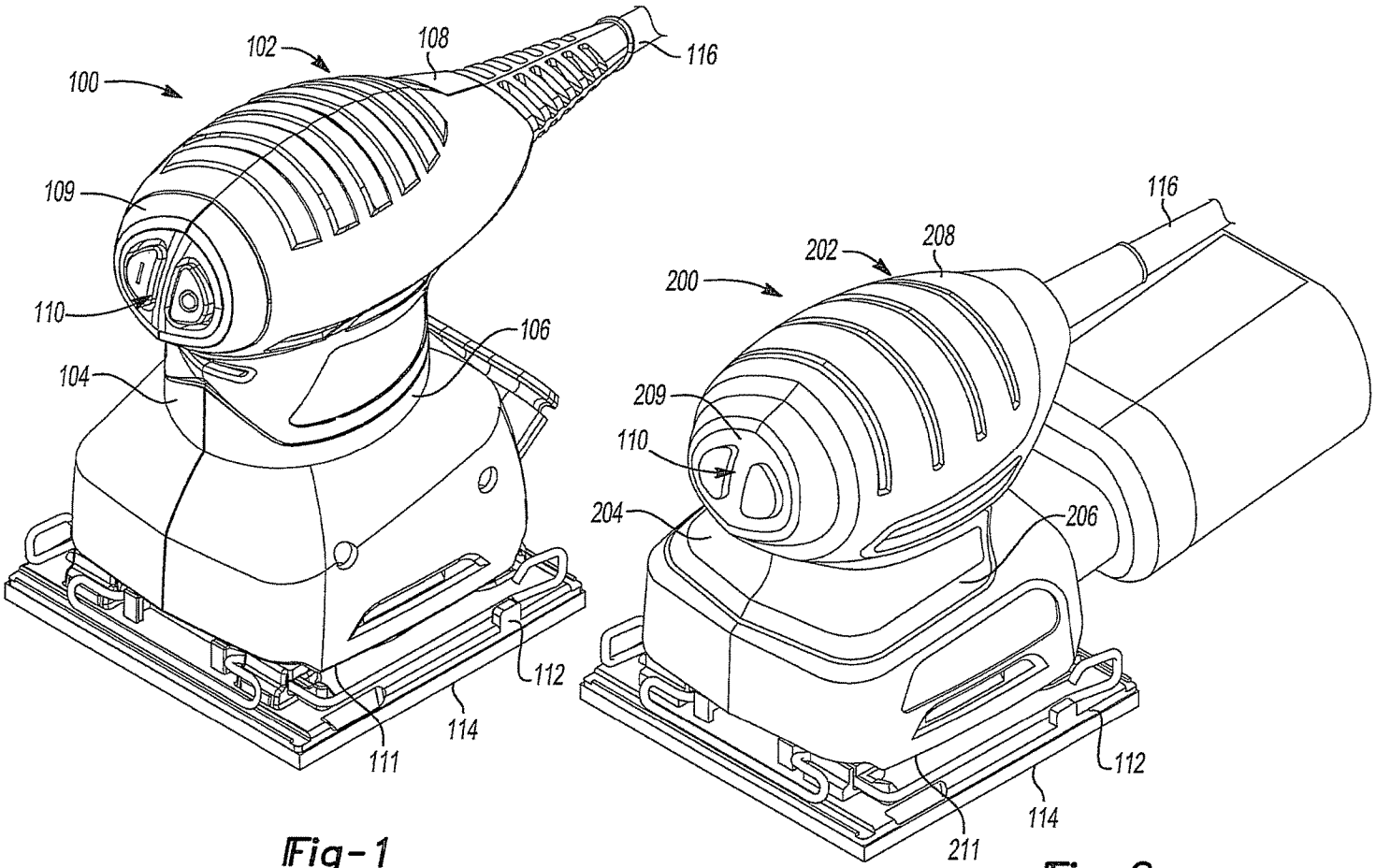
Fig-1 PRIOR ART
FIG. 1 is side perspective view of a prior art ¼ sheet electric sander.
FIG. 2 is a side perspective view of a reduced height ¼ sheet electric sander in accordance with an aspect of the present disclosure.
Figure 3:
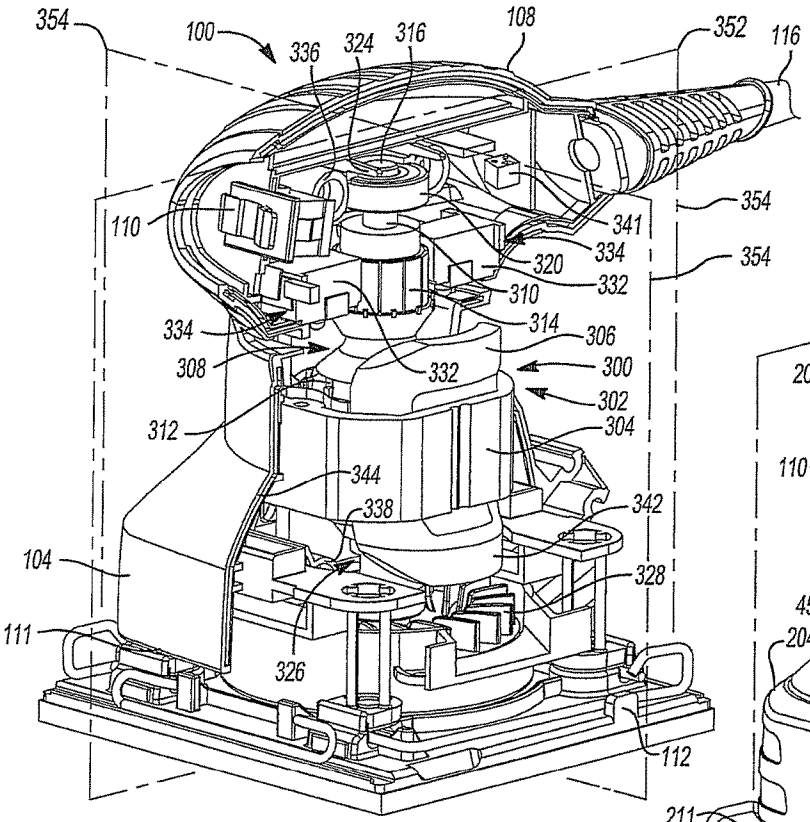
Fig-3 PRIOR ART
FIG. 3 is a side perspective view, partially cut away, of the sander of FIG. 1.

The following description is merely exemplary in nature and is not intended to limit the present disclosure, application, or uses. It should be understood that throughout the drawings, corresponding reference numerals indicate like or corresponding parts and features.

Figure 6:
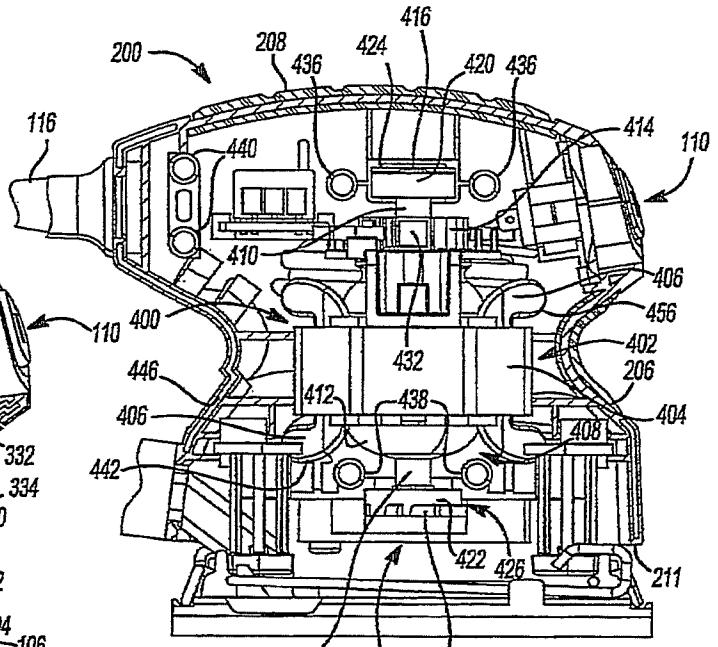
FIG. 6 is a side sectional view of the sander of FIG. 2.
Figure 5:
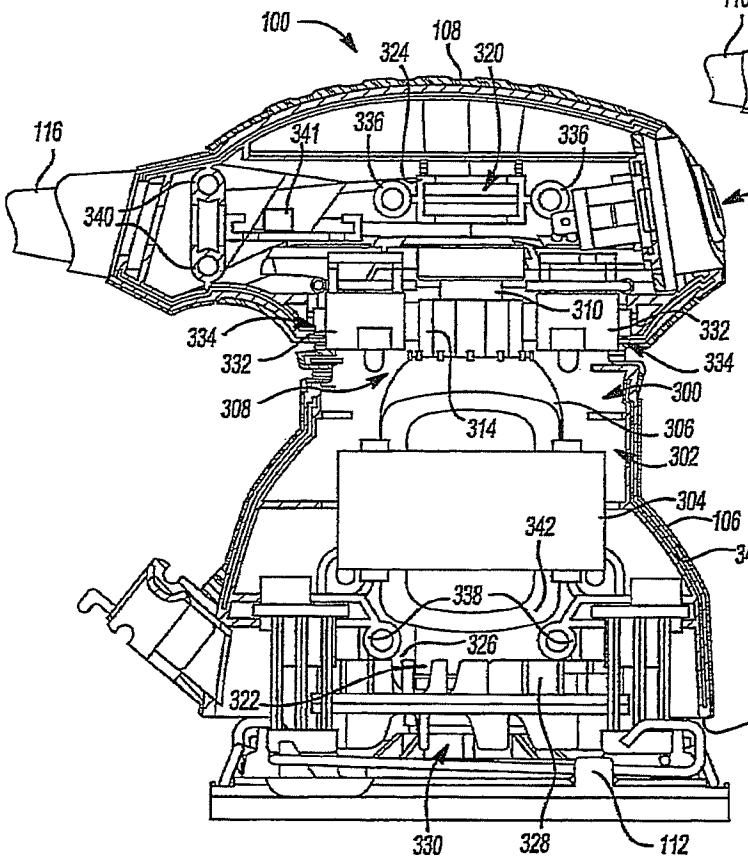
Fig-5 PRIOR ART
FIG. 5 is a side sectional view of the sander of FIG. 1.

With reference to FIGS. 2, 4, 6, and 8, a reduced profile ¼ sheet sander 200 is shown. Sander 200 has a housing 202 having first and second clamshell halves 204, 206 mated together. Housing 202 and first and second clamshell halves 204, 206 are similar to housing 102 and first and second clamshell halves 104, 106 of sander 100, but having a reduced height as discussed below. An upper end of housing 202 is formed as a handle 208. On-off switch 110 is disposed in a front end 209 of handle 208 of housing 202. An electric motor 400 (FIGS. 4 and 6) is disposed in housing 202. Electric motor 400 is a universal AC motor having a field or stator 402 and an armature 408. Stator 402 includes a lamination stack 404 having field coils 406 wound in slots (not shown) therein. Motor 400 may illustratively be a two-pole motor and stator 402 includes two field coils 406. Armature 408 extends through lamination stack 404 of stator 402. Armature 408 has an armature shaft 410 extending through and affixed to a lamination stack 412 (FIG. 6). Lamination stack 412 includes slots (not shown) in which armature coils (not shown) are wound. Portions of armature shaft 410 generally at upper end 416 and lower end 418 (FIG. 6) thereof (as oriented in the drawings) are entrained in upper bearing 420 and lower bearing 422 (FIG. 6) (as oriented in the drawings). Upper and lower bearings 420, 422 are received in bearing holders 424, 426 formed in clamshell halves 204, 206 of housing 202. A commutator 414 is affixed to armature shaft 410 toward upper end 416. Electric motor 400 may illustratively be a 230 volt, 50 Hz, 200 watt, 16,000 RPM (no load speed) motor or a 120 volt, 60 Hz, 2 amp, 16,000 RPM (no load speed) motor.

A fan 428 is affixed to armature shaft 410 toward lower end of 418 of armature shaft 410 and an orbit mechanism 430 is coupled to the lower end 418 of armature shaft 410. Fan 428 is illustratively disposed in housing 202 and at least a portion of orbit mechanism 430 (FIG. 6) extends below a bottom 211 of housing 202. A platen 112 is coupled to orbit mechanism 430. A ¼ sheet of sandpaper 114 is removably secured to the bottom of platen 112.

Clamshell housing halves 204, 206 each include a plurality of screw bosses, illustratively six, for receiving screws (such as screws 458 in FIG. 4) that hold clamshell halves 204, 206 together. The screw bosses may illustratively be threaded screw bosses in one of clamshell halves 204, 206 and through holes in the other of clamshell halves 204, 206. The screw bosses of each clamshell housing half include a pair of upper screw bosses 436 generally at opposite sides of upper bearing 420, a pair of lower screw bosses 438 generally at and slightly above opposite sides of lower bearing 422, and a pair of screw bosses 440 at an upper back end of handle 208 of housing 202 generally where a cordset 116 enters housing 402 and connects to a terminal block 441. When clamshell halves 204, 206 are mated together, the screw bosses extend across housing 202 from one clamshell half 204 to the other clamshell half 206.

Electric motor 400 is similar to electric motor 300 of sander 100, but with the following differences. The height of lamination stack 404 of stator 402 is shorter than the height of lamination stack 304 of stator 302, illustratively by about twenty percent. In an aspect, the height of lamination stack 404 of stator 402 is about 20 mm compared with the 25 mm height of lamination stack 304 of stator 302. The height of lamination stack 412 of armature 408 is correspondingly reduced. The height of commutator 414 of armature 408 of electric motor 400 is shorter than the height of commutator 314 of armature 308 of electric motor 300, illustratively by about 4 mm. In an aspect, the height of commutator 414 is about 11 mm compared with the 15 mm height of commutator 314 of armature 308. This allows the height of sander 200 to be reduced compared to the height of sander 100 as the overall height of electric motor 400 is shorter compared to the height of electric motor 300 of sander 100, and the height of sander 200 is so reduced.

Sander 200 includes two brush boxes 432 affixed to a brush ring 433. The brush ring 433 may illustratively be secured in housing 202 with screws (not shown) that pass through holes in lamination stack 404 of stator 402. Brush ring 433 is secured in housing 202 with brush boxes 432 disposed on opposite sides of commutator 414 so that one brush box 432 is disposed in clamshell half 204 and the other brush box 432 is disposed in clamshell half 206. Stator 402 of electric motor 400 is located in housing 202 so that the two field coils 406 bridge across clamshell halves 204, 206. When clamshell halves 204, 206 are mated, edge 444 of clamshell half 204 and edge 446 of clamshell half 206 define a vertical plane 452 (FIG. 4) (when sander 200 is upright). A horizontal (when sander 200 is upright) centerline 450 (FIG. 8) of field coils 406 lies in vertical plane 452 and a horizontal centerline 448 (FIG. 8) of brush boxes 432 lies in a plane 454 that is rotated ninety degrees with respect to plane 452. Centerline 448 of brush boxes 432 and centerline 450 of field coils 406 are thus rotated ninety degrees with each other. In sander 200, brush boxes 432 and field coils 406 are rotated (about a vertical axis when sander 200 is upright) ninety degrees in housing 202 compared with brush boxes 332 and field coils 306 of sander 100.

Figure 4:
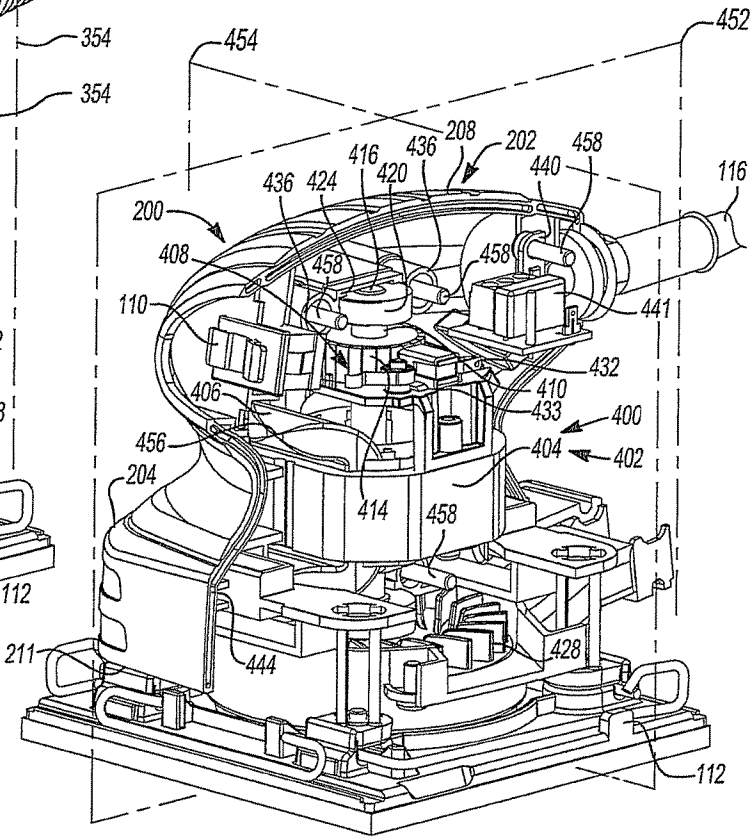
FIG. 4 is a side perspective view, partially cut away, of the sander of FIG. 2.

By rotating brush boxes 432 in housing 202 of sander 200 compared with brush boxes 332 in housing 102 of sander 100, switch 110 and terminal block 441 can be located in the space occupied by brush boxes 332 of sander 100 and in generally the same horizontal elevation (when sander 200 is upright) as brush boxes 432. In this regard, as can be seen from FIGS. 4 and 6, switch 110 and terminal block 441 are disposed on opposite sides of commutator 414. Switch 110 is thus disposed on its side of commutator 414 between brush boxes 442 and terminal block 441 is thus disposed on its side of commutator 414 between brush boxes 442. Thus, as can be seen in FIG. 4, vertical plane 452 defined by the edges 444, 446 of housing halves 204, 206 intersects switch 110 and terminal block 441, but not brush boxes 442.

In contrast, switch 110 and terminal block 341 of sander 100 are located in housing 102 a horizontal elevation (when sander 100 is upright) that is above the horizontal elevation in which brush boxes 332 of sander 100. This also allows the height of sander 200 to be reduced compared to the height of sander 100, and the height of sander 200 is so reduced.

Figure 8:
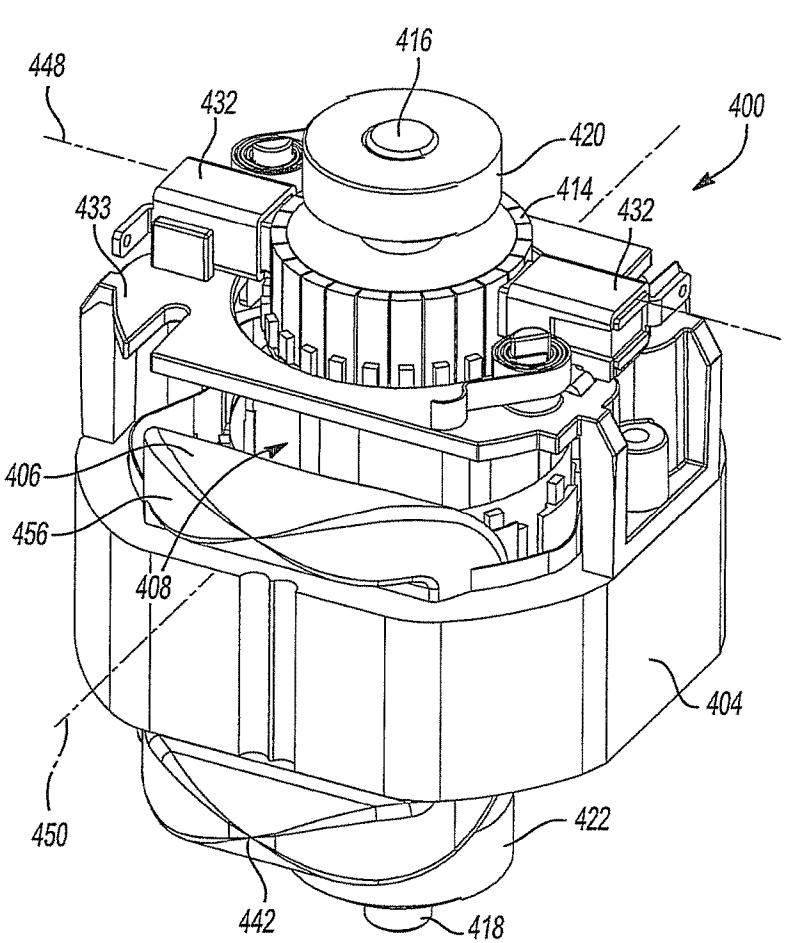
FIG. 8 is a side perspective view of an electric motor and brush boxes of the sander of FIG. 2.
Figure 7:
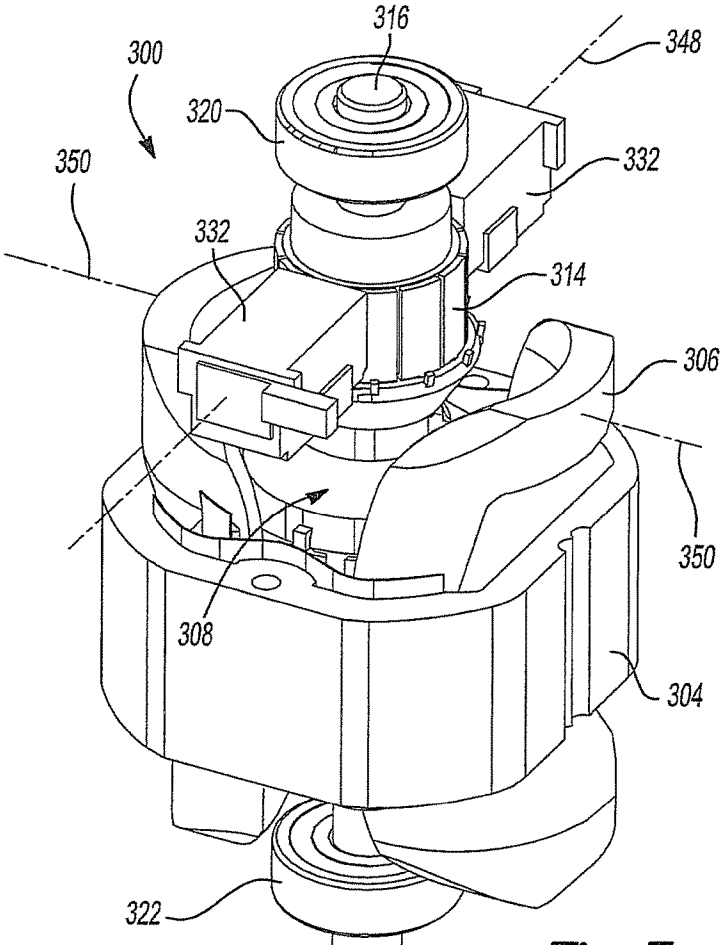
Fig-7 PRIOR ART
FIG. 7 is a side perspective view of an electric motor and brush boxes of the sander of FIG. 1.

By rotating field coils 406 of stator 402 ninety degrees compared with field coils 306 of stator 302, the field coils 406 are disposed outside of lower screw bosses 438 and lower ends 442 of field coils 406 can be horizontally adjacent (when sander 200 is upright), or even below, lower screw bosses 438. This allows stator 402 and armature 408 of electric motor 400 to be moved down compared to stator 302 and armature 308 of electric motor 300 of sander 200. This also allows the height of sander 200 to be reduced compared to the height of sander 100, and the height of sander is so reduced. Field coils 406 are also bent over to reduce the overall height of field coils 406. As shown in FIGS. 4, 6 and 8, upper ends 456 and lower ends 442 of field coils 406 are bent outwardly and toward each other. This also allows the height of sander 200 to be reduced compared to the height of sander 100, and the height of sander 200 is so reduced.

To further reduce the height of sander 200, electrical creepage and electrical inaccessibility dimensions may be minimized consistent with UL or other similar requirements.

In an aspect, sander 200 illustratively has a vertical height, the height from the top of housing 202 to the bottom of platen 112, of 135 mm or less. In an aspect, sander 200 illustratively has a vertical height of 130 mm or less. In an aspect, sander 200 illustratively has a vertical height that does not exceed about 125 mm (i.e., 125 mm+/−3 mm). In an aspect, sander 200 has a vertical height that is about 125 mm.

What is claimed is:

1. A sander, comprising:

a housing;

an electric motor disposed in the housing having a stator and an armature, the stator having field coils and the armature having an armature shaft on which a commutator is affixed;

a pair of brush boxes disposed in the housing on opposite sides of the commutator;

an orbit mechanism coupled to the armature shaft; and a platen coupled to the orbit mechanism;

wherein the field coils comprise a first field coil facing a front of the sander and a second field coil facing a rear of the sander; and wherein the brush boxes are rotationally offset from the field coils with respect to a vertical axis of the sander.

2. The sander of claim 1, wherein the brush boxes are rotationally offset from the field coils with respect to the vertical axis of the sander by about 90 degrees.

3. The sander of claim 1, wherein the housing comprises first and second halves that are mated together;

wherein edges of the halves of the housing define a vertical plane when the halves are mated together and the sander is upright; and wherein the vertical plane intersects the field coils.

4. The sander of claim 3, wherein the vertical plane does not intersect the brush boxes.

5. The sander of claim 3, wherein the first and second halves of the housing have lower screw bosses generally on opposite sides of the electric motor that extend across the housing from one half to the other half, the stator disposed in the housing so that the field coils extend across the housing from one half to the other half and outside the lower screw bosses wherein bottoms of the field coils are horizontally adjacent or below the lower screw bosses when the sander is upright.

6. The sander of claim 1, wherein the housing comprises first and second halves that are mated together;

wherein edges of the halves of the housing define a vertical plane when the halves are mated together and the sander is upright; and wherein the vertical plane intersects the front and the rear of the sander.

7. The sander of claim 6, wherein the vertical plane does not intersect the brush boxes.

8. The sander of claim 1, wherein the sander is a quarter sheet sander and has a vertical height that does not exceed 135 mm.

9. The sander of claim 1, wherein top and bottom portions of the field coils are bent outwardly and toward each other.

10. The sander of claim 1 further comprising a brush ring, the brush ring being supported by the stator and holding the brush boxes.

11. The sander of claim 1, wherein power is provided to the electric motor from the rear of the sander.

12. The sander of claim 1, wherein power is provided to the electric motor through a cordset which meets the housing at the rear of the sander.

13. A sander, comprising:

a housing;

an electric motor disposed in the housing having a stator and an armature, the stator having field coils and the armature having an armature shaft on which a commutator is affixed;

a pair of brush boxes disposed in the housing on opposite sides of the commutator;

an orbit mechanism coupled to the armature shaft; and a platen coupled to the orbit mechanism;

a brush ring being supported by the stator and holding the brush boxes;

wherein the field coils comprise a first field coil facing a first direction and a second field coil facing a second direction, opposite the first direction;

wherein the brush boxes are rotationally offset from the field coils with respect to a vertical axis of the sander.

14. The sander of claim 13, wherein the brush boxes are rotationally offset from the field coils with respect to the vertical axis of the sander by about 90 degrees.

15. The sander of claim 13, wherein the housing comprises first and second halves that are mated together;

wherein edges of the halves of the housing define a vertical plane when the halves are mated together and the sander is upright; and wherein the vertical plane intersects the field coils.

16. The sander of claim 15, wherein the vertical plane does not intersect the brush boxes.

17. The sander of claim 15, wherein the vertical plane intersects the field coils near a center of the field coils.

18. The sander of claim 13, wherein the brush ring is secured to the stator.

19. The sander of claim 18, wherein the brush ring is secured to the stator by a securing element.

* * * * *